US008730142B2

(12) United States Patent
Shu

(10) Patent No.: US 8,730,142 B2
(45) Date of Patent: May 20, 2014

(54) GATE LINE DRIVE CIRCUIT

(75) Inventor: Takayuki Shu, Kanagawa (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 936 days.

(21) Appl. No.: 12/461,084

(22) Filed: Jul. 30, 2009

(65) Prior Publication Data

US 2010/0033417 A1 Feb. 11, 2010

(30) Foreign Application Priority Data

May 8, 2008 (JP) ..... 2008-202187

(51) Int. Cl.
*G09G 3/36* (2006.01)

(52) U.S. Cl.
USPC ..... 345/99; 345/90; 345/98; 345/100

(58) Field of Classification Search
USPC ..... 345/100, 99
See application file for complete search history.

(56) References Cited

U.S. PATENT DOCUMENTS

| | | | | |
|---|---|---|---|---|
| 6,195,077 | B1 * | 2/2001 | Gyouten et al. | 345/99 |
| 6,717,566 | B2 | 4/2004 | Wang | |
| 2002/0080108 | A1 | 6/2002 | Wang | |
| 2006/0238473 | A1 * | 10/2006 | Hashimoto | 345/89 |
| 2007/0229442 | A1 * | 10/2007 | Yi | 345/100 |
| 2008/0165112 | A1 * | 7/2008 | Su | 345/100 |

FOREIGN PATENT DOCUMENTS

JP 2002-215119 A 7/2002

* cited by examiner

*Primary Examiner* — Charles V Hicks
(74) *Attorney, Agent, or Firm* — McGinn IP Law Group, PLLC

(57) ABSTRACT

A gate line drive circuit includes: X level shift circuits configured to convert first address signals into second address signals; and a logic circuit configured to drive a selection gate line of N gate lines of a display unit based on the second address signals by supplying a first driving voltage to the selection gate line and by supplying a second driving voltage to non-selection gate lines of the N gate lines other than the selection gate line. X is an integer of 1 or more. N is equal to 2 raised to a power X. The first address signals includes X voltages each of which is a first voltage or a second voltage. The second address signals includes X driving voltages each of which is the first driving voltage or the second driving voltage.

20 Claims, 7 Drawing Sheets

Fig. 6A

| GATE LINE | GATE LINE ADDRESS | | | | | | | | |
|---|---|---|---|---|---|---|---|---|---|
| | $2^{(X-1)}$ | $2^{(X-2)}$ | $2^{(X-3)}$ | ··· | $2^4$ | $2^3$ | $2^2$ | $2^1$ | $2^0$ |
| G_1 | 0 | 0 | 0 | ··· | 0 | 0 | 0 | 0 | 1 |
| G_2 | 0 | 0 | 0 | ··· | 0 | 0 | 0 | 1 | 0 |
| G_3 | 0 | 0 | 0 | ··· | 0 | 0 | 0 | 1 | 1 |
| G_4 | 0 | 0 | 0 | ··· | 0 | 0 | 1 | 0 | 0 |
| G_5 | 0 | 0 | 0 | ··· | 0 | 0 | 1 | 0 | 1 |
| G_6 | 0 | 0 | 0 | ··· | 0 | 0 | 1 | 1 | 0 |
| G_7 | 0 | 0 | 0 | ··· | 0 | 0 | 1 | 1 | 1 |
| G_8 | 0 | 0 | 0 | ··· | 0 | 1 | 0 | 0 | 0 |
| ··· | ··· | ··· | ··· | ··· | ··· | ··· | ··· | ··· | ··· |
| G_(N-3) | 1 | 1 | 1 | ··· | 1 | 1 | 1 | 0 | 1 |
| G_(N-2) | 1 | 1 | 1 | ··· | 1 | 1 | 1 | 1 | 0 |
| G_(N-1) | 1 | 1 | 1 | ··· | 1 | 1 | 1 | 1 | 1 |
| G_N | 0 | 0 | 0 | ··· | 0 | 0 | 0 | 0 | 0 |

Fig. 6B

| GATE LINE | GATE LINE ADDRESS | | | | | | | | | |
|---|---|---|---|---|---|---|---|---|---|---|
| | $2^9$ | $2^8$ | $2^7$ | $2^6$ | $2^5$ | $2^4$ | $2^3$ | $2^2$ | $2^1$ | $2^0$ |
| G_1 | 0 | 0 | 0 | 0 | 0 | 0 | 0 | 0 | 0 | 1 |
| G_2 | 0 | 0 | 0 | 0 | 0 | 0 | 0 | 0 | 1 | 0 |
| G_3 | 0 | 0 | 0 | 0 | 0 | 0 | 0 | 0 | 1 | 1 |
| G_4 | 0 | 0 | 0 | 0 | 0 | 0 | 0 | 1 | 0 | 0 |
| G_5 | 0 | 0 | 0 | 0 | 0 | 0 | 0 | 1 | 0 | 1 |
| G_6 | 0 | 0 | 0 | 0 | 0 | 0 | 0 | 1 | 1 | 0 |
| G_7 | 0 | 0 | 0 | 0 | 0 | 0 | 0 | 1 | 1 | 1 |
| G_8 | 0 | 0 | 0 | 0 | 0 | 0 | 1 | 0 | 0 | 0 |
| ... | ... | ... | ... | ... | ... | ... | ... | ... | ... | ... |
| G_1021 | 1 | 1 | 1 | 1 | 1 | 1 | 1 | 1 | 0 | 1 |
| G_1022 | 1 | 1 | 1 | 1 | 1 | 1 | 1 | 1 | 1 | 0 |
| G_1023 | 1 | 1 | 1 | 1 | 1 | 1 | 1 | 1 | 1 | 1 |
| G_1024 | 0 | 0 | 0 | 0 | 0 | 0 | 0 | 0 | 0 | 0 |

GATE LINE DRIVE CIRCUIT

INCORPORATION BY REFERENCE

This application is based upon and claims the benefit of priority from Japanese patent application No. 2008-202187, filed on Aug. 5, 2008, the disclosure of which is incorporated herein in its entirety by reference.

BACKGROUND OF THE INVENTION

1. Field of the Invention

The present invention relates to a gate line drive circuit for driving a gate line of a display device.

2. Description of Related Art

Display devices such as a TFT-LCD (Thin Film Transistor-Liquid Crystal Display), a passive matrix liquid crystal display, an electroluminescence (EL) display, and a plasma display have been widely spread. The TFT-LCD will be explained as an example of the above-mentioned display devices.

In the TFT-LCD, a timing controller, for example, supplies a gate line address signal for selecting a selection gate line from N gate lines to a gate line drive circuit in one horizontal period. N is 2 raised to the power n, where n is a positive integer. The gate line drive circuit supplies a first driving voltage VGH for driving the selection gate line to the selection gate line based on the gate line address signal, and supplies a second driving voltage VGL for not driving non-selection gate lines that are gate lines other than the selection gate line to the non-selection gate lines. The second driving voltage VGL is lower than the first driving voltage VGH. In this case, the first driving voltage VGH is transmitted from one end to the other end of the selection gate line, and TFTs (Thin Film Transistors) of pixels corresponding to the selection gate line are turned on based on the first driving voltage supplied to the gate electrodes of the TFTs.

The above-mentioned gate line address signal includes N address signals. One address signal of the N address signals represents a first voltage VDD for selecting the selection gate line, and each of the other address signals represents a second voltage VCC for selecting the non-selection gate line. The second voltage VCC is lower than the first voltage VDD. The first voltage VDD generally represents a voltage of approximately 1 to 5 [V], the second voltage VCC represents, for example, 0 [V] as a ground voltage. In addition, the above-mentioned first driving voltage VGH and the second driving voltage VGL are approximately 20 [V] and −20 [V], respectively. Accordingly, the gate line drive circuit requires N level shift circuits for converting the first voltages VDD and the second voltages VCC of the N address signals into the first driving voltages VGH and the second driving voltages VGL.

The N level shift circuits are provided corresponding to the number of the gate lines, N, and each of the level shift circuits includes transistors. High-voltage transistors are required to be employed as the transistors. FIG. 1 shows a level shift circuit as an example. Each of the N level shift circuits includes, for example, a two-stage differential amplifier. The two-stage differential amplifier includes ten of high-voltage transistors P11, P12, N11, N12, N13, N14, P21, P22, N21, and N22.

However, the high-voltage transistor occupies a larger area than a low-voltage transistor which is, for example, used for a logic gate. For this reason, when the gate line drive circuit is formed on a chip, the level shift circuit occupies a large area in a whole area of the chip. In addition, in accordance with the number of gate lines, N, many high-voltage transistors are used. The larger the number of the high-voltage transistors is, the much larger area the level shift circuit occupies.

Accordingly, it is desired to reduce a ratio of the number of the level shift circuits to the number of the gate lines, N.

FIG. 2 shows a gate line drive circuit 120 as a gate line drive circuit described in Japanese Laid Open Patent Application (JP-P2002-215119A).

The gate line drive circuit 120 includes a gate line logic circuit 124, a first level shift circuit module 126, a second level shift circuit module 128, and a multiplexer 122. N gate lines G_1 to G_N are grouped into L groups GR_1 to GR_L each of which includes K gate lines. A relation among N, K, and L is given by N=L×K.

The gate line logic circuit 124 outputs, as signals corresponding to the above-mentioned gate line address signal, K scan signals SR_1 to SR_K to the first level shift circuit module 126 and L pairs of control signals C_1, C_1' to C_L, C_L' to the second level shift circuit module 128. The L control signals C_1' to C_L' are inversion signals of the L control signals C_1 to C_L. The gate line logic circuit 124 outputs the L pairs of control signals C_1, C_1' to C_L, C_L' to the second level shift circuit module 128 in the order from a first pair of control signals C_1 and C_1' to an L-th pair of control signals C_L and C_L'. In addition, the gate line logic circuit 124 outputs the K scan signals SR_1 to SR_K to the first level shift circuit module 126 in the order from the first scan signal SR_1 to the K-th scan signal SR_K while outputting each pair of the L pairs of control signals C_1, C_1' to C_L, and C_L. The K scan signals SR_1 to SR_K represent, for example, the above-mentioned first voltage VDD.

The first level shift circuit module 126 includes K level shift circuits LSD_1 to LSD_K and is supplied with a first driving voltage VGH. The K level shift circuits LSD_1 to LSD_K convert the first voltage VDD represented by the K scan signals SR_1 to SR_K into the first driving voltage VGH, and output the first driving voltage VGH as driving signals D_1 to D_K to the multiplexer 122.

The second level shift circuit module 128 includes L pairs of level shift circuits LSC_1, LSC_1' to LSC_L, LSC_L'. The L pairs of level shift circuits LSC_1, LSC_1' to LSC_L, LSC_L' convert voltages represented by the L pairs of control signals C_1, C_1' to C_L, C_L' into predetermined voltages, and output the predetermined voltages to the multiplexer 122.

FIG. 3 shows the multiplexer 122. The multiplexer 122 includes N first transistors and N second transistors. For example, N-channel type MOSFETs (Metal-Oxide-Semiconductor Field Effect Transistors) are employed as the first transistors and the second transistors. Sources of the N first transistors are respectively connected to the N gate lines G_1 to G_N and respectively connected to drains of the N second transistors. A second driving voltage VGL is supplied to sources of the N second transistors. The N first transistors and the N second transistors are grouped into L groups GR_1 to GR_L each of which includes K first transistors and K second transistors. Drains of the K first transistors are connected to the K level shift circuits LSD_1 to LSD_K of the first level shift circuit module 126, respectively. Gates of the respective first transistors of the L groups GR_1 to GR_L are connected to outputs of the L level shift circuits LSC_1 to LSC_L of the second level shift circuit module 128, and supplied with the L control signals C_1 to C_L, respectively. Gates of the respective second transistors of the L groups GR_1 to GR_L are connected to outputs of the L level shift circuits LSC_1' to LSC_L' of the second level shift circuit module 128, and supplied with the L control signals C_1' to C_L', respectively.

FIG. 4 is a timing chart showing an operation of the multiplexer 122. As a process with respect to the group GR_1, the multiplexer 122 receives the K scan signals SR_1 to SR_K from the first level shift circuit module 126 in the order from the first scan signal SR_1 to the K-th scan signal SR_K while receiving the first pair of control signals C_1 and C_1' from the second level shift circuit module 128. In this case, the multiplexer 122 supplies the first driving voltage VGH to the K gate lines of the group GR_1 in the order from the first gate line to the K-th gate line, and supplies the second driving voltage VGL to the gate lines of the groups other than the group GR_1. By carrying out the same process with respect to the groups GR_2 to GR_L, the first driving voltage VGH is supplied to the N gate lines G_1 to G_N in the order from the first gate line to the N-th gate line.

As for the gate line drive circuit 120, the number of the level shift circuits used for driving the N gate lines G_1 to G_N is represented by 2×L+K. For example, given that N is 1024 and L is 8, K is 128 based on K=N/L. In this case, the number of the level shift circuits is 144 based on 2×L+K. In this manner, the ratio of the number of the level shift circuits to the number of the gate lines, N can be reduced.

In these years, as exemplified with respect to microcomputers or portable terminals, downsizings of chips and packages are increasingly demanded. In order to downsize the chips and the packages, reduction of a chip area is required.

As for the gate line drive circuit 120, the ratio of the number of the level shift circuits to the number the of gate lines, N is reduced, however, the (2×L+K) level shift circuits are still required. As described above, a plurality of high-voltage transistors are used in one level shift circuit and the high-voltage transistor occupies a larger area than a low-voltage transistor which is, for example, used for a logic gate. For example, in a chase that ten high-voltage transistors are used in each of the above-described 144 level shift circuits and the gate line drive circuit 120 including the 144 level shift circuits is formed on a chip, at least an area for 1440 high-voltage transistors is required in a whole area of the chip.

As described above, there is a room for further improvement in the above-mentioned gate line drive circuit.

SUMMARY

In one embodiment, a gate line drive circuit includes: X level shift circuits configured to convert first address signals into second address signals; and a logic circuit configured to drive a selection gate line of N gate lines of a display unit based on the second address signals by supplying a first driving voltage to the selection gate line and by supplying a second driving voltage to non-selection gate lines of the N gate lines other than the selection gate line. X is an integer of 1 or more. N is equal to 2 raised to a power X. The first address signals includes X voltages each of which is a first voltage or a second voltage. The second address signals includes X driving voltages each of which is the first driving voltage or the second driving voltage.

In another embodiment, a display device includes: a display unit including pixels arranged in N rows and M columns; N gate lines respectively corresponding to the N rows; M data lines respectively corresponding to the M columns; a gate line drive circuit connected to the N gate lines and configured to drive a selection gate line of the N gate lines; and a data line drive circuit connected to the M data lines and configured to display pieces of display data on first pixels of the pixels. The first pixels are connected to the selection gate line. The data line drive circuit includes: X level shift circuits configured to convert first address signals into second address signals; and a logic circuit configured to supply a first driving voltage to the selection gate line to drive the selection gate line and supply a second driving voltage to non-selection gate lines of the N gate lines other than the selection gate line not to drive the non-selection gate lines based on the second address signals. X is an integer of 1 or more. N is equal to 2 raised to a power X. M is an integer of 1 or more. The first address signals includes X voltages each of which is a first voltage or a second voltage. The second address signals includes X driving voltages each of which is the first driving voltage or the second driving voltage.

In another embodiment, a gate line driving method includes: converting first address signals into second address signals; and driving a selection gate line of N gate lines of a display unit based on the second address signals by supplying a first driving voltage to the selection gate line and by supplying a second driving voltage to non-selection gate lines of the N gate lines other than the selection gate line. N is equal to 2 raised to a power X. X is an integer of 1 or more. The first address signals includes X voltages each of which is a first voltage or a second voltage. The second address signals includes X driving voltages each of which is the first driving voltage or the second driving voltage.

According to the gate line drive circuit, the display device, and the gate line driving method, the required number of level shift circuits is only $\log_2$ N, where N is the number of gate lines. Thus, the number of the level shift circuits can be reduced.

As described above, as for the conventional gate line drive circuit 120, the number of the level shift circuits used for driving the N gate lines G_1 to G_N is represented by 2×L+K. For example, given that N is 1024 and L is 8, K is 128 based on K=N/L. In this case, the number of the level shift circuits is 144 based on 2×L+K.

Meanwhile, as for the gate line drive circuit in the embodiment, the number, X, of the level shift circuits used for driving the N gate lines is represented by $\log_2$ N. For example, given that N is 1024, X is 10 based on X=$\log_2$ N. Namely, the number of the level shift circuits in the embodiment is much smaller than the number of the level shift circuits in the conventional gate line drive circuit 120.

In addition, since the number of the level shift circuits of the gate line drive circuit in the embodiment is much smaller than the number of the level shift circuits in the conventional gate line circuit 120, a chip area in a case that the gate line drive circuit in the embodiment is formed on a chip can be significantly reduced as compared to a chip area in a case of the conventional gate line drive circuit 120. Moreover, a manufacturing cost of the chip can be significantly reduced.

BRIEF DESCRIPTION OF THE DRAWINGS

The above and other objects, advantages and features of the present invention will be more apparent from the following description of certain preferred embodiments taken in conjunction with the accompanying drawings, in which:

FIG. 6A shows a truth table 22 of FIG. 5; and

FIG. 6B shows one example of the truth table 22 of FIG. 5.

DESCRIPTION OF PREFERRED EMBODIMENTS

The invention will be now described herein with reference to illustrative embodiments. Those skilled in the art will recognize that many alternative embodiments can be accomplished using the teachings of the present invention and that the invention is not limited to the embodiments illustrated for explanatory purposes.

Referring to attached drawings, a gate line drive circuit, a display device, and a gate line driving method according to embodiments of the present invention will be explained below in detail. A TFT-LCD (Thin Film Transistor-Liquid Crystal Display), a passive matrix liquid crystal display, an electroluminescence (EL) display, a plasma display, or the like is given as a display device to which the gate line drive circuit according to the embodiment of the present invention is applied. The TFT-LCD will be explained as an example of the above-mentioned display device.

Figure 1:
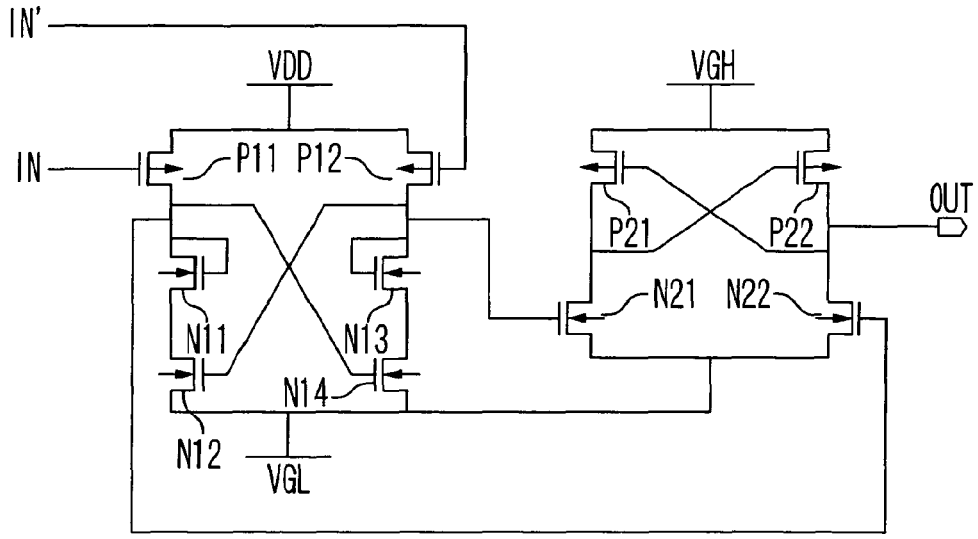
Fig. 1 RELATED ART
FIG. 1 shows one example of a level shift circuit.
Figure 2:
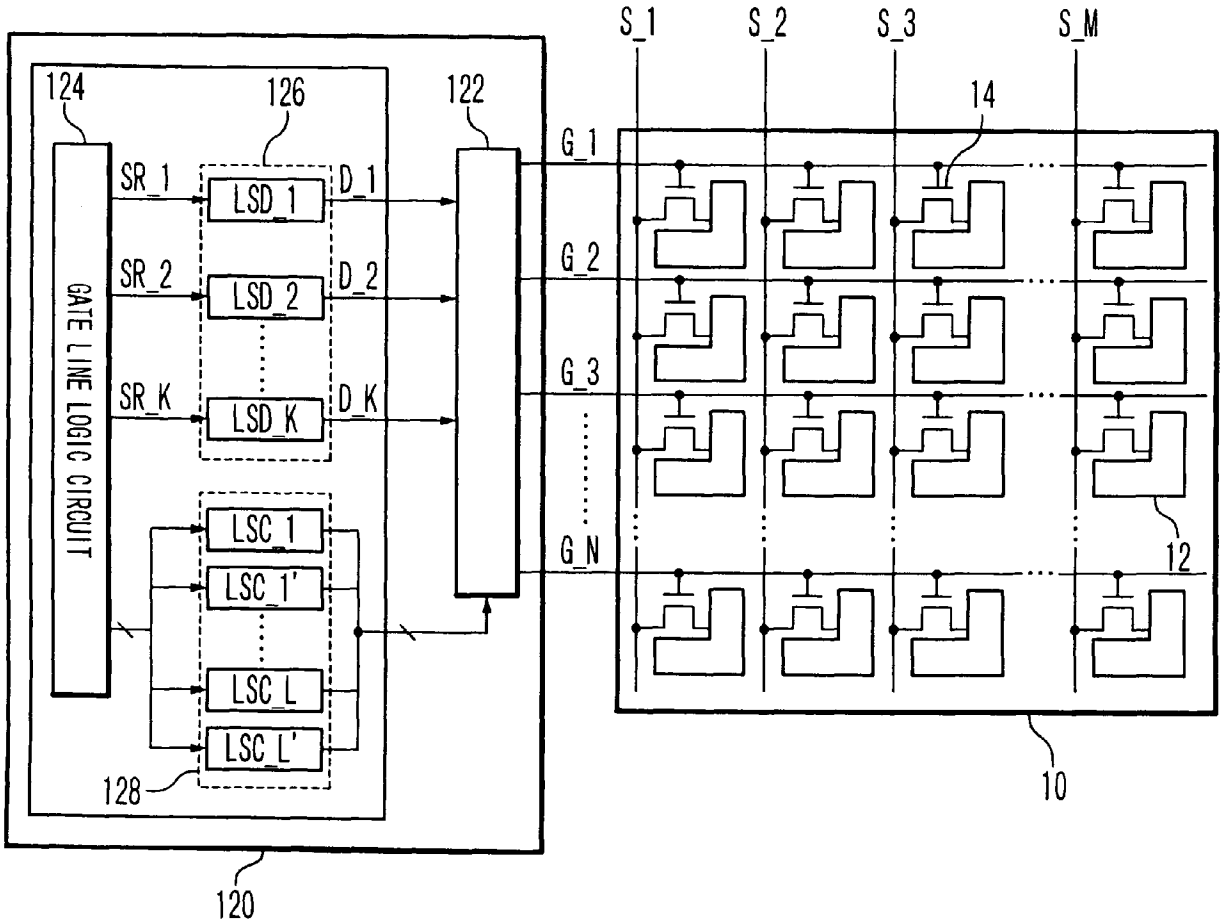
Fig. 2 PRIOR ART
FIG. 2 shows a gate line drive circuit 120 as a gate line drive circuit described in Japanese Laid Open Patent Application (JP-P2002-215119A)
Figure 3:
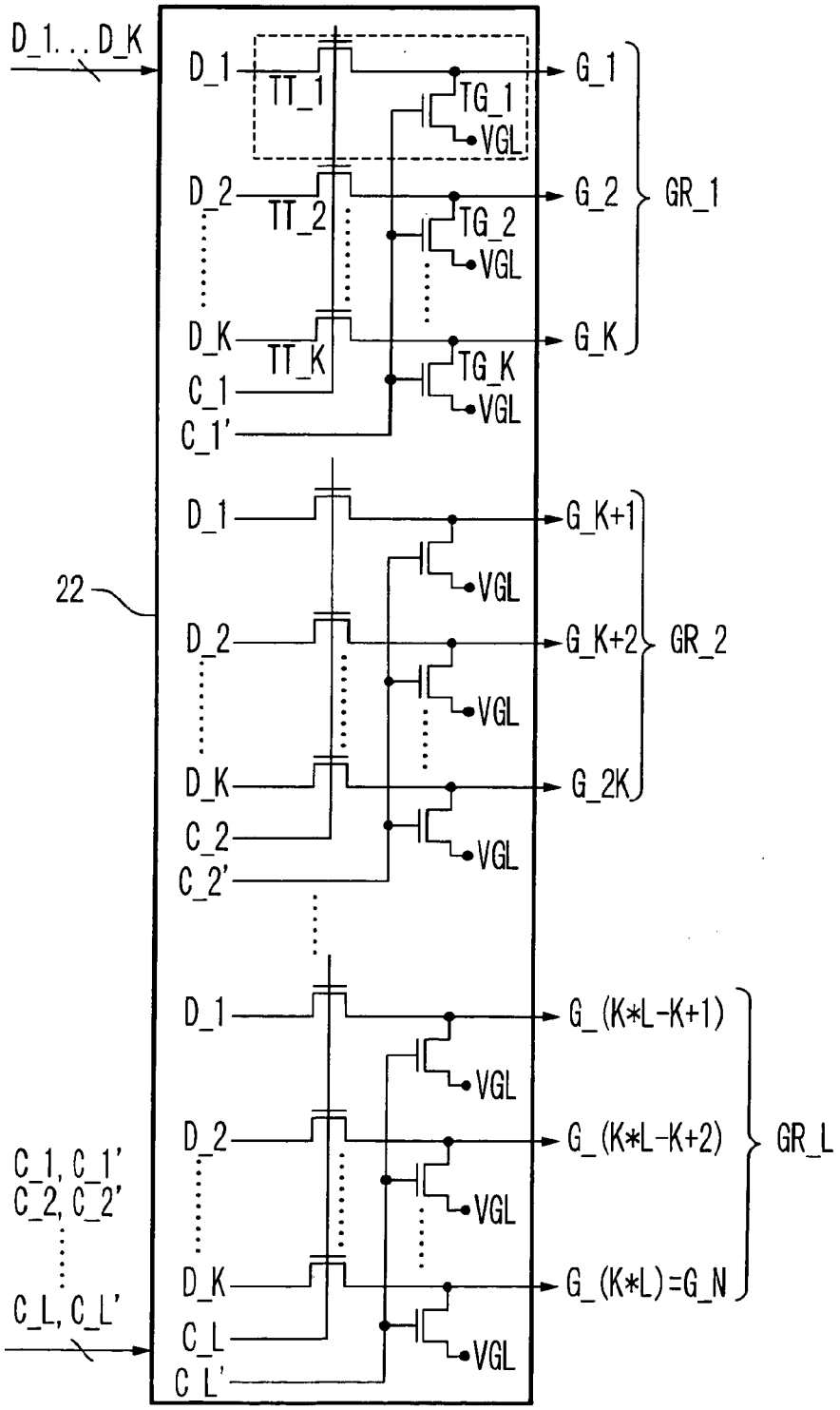
Fig. 3 PRIOR ART
FIG. 3 shows a multiplexer 122 of FIG. 2.
Figure 4:
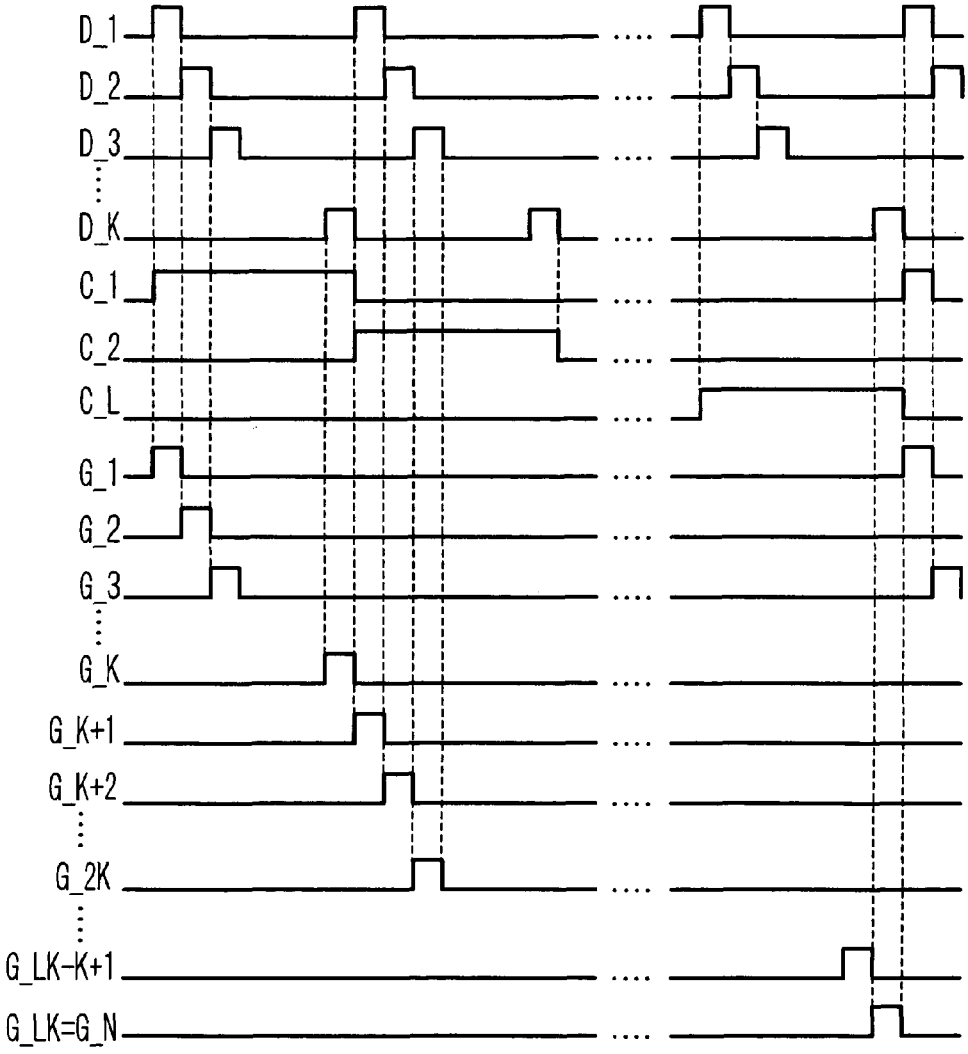
Fig. 4 PRIOR ART
FIG. 4 is a timing chart showing an operation of the multiplexer 122 of FIG. 3.
Figure 5:
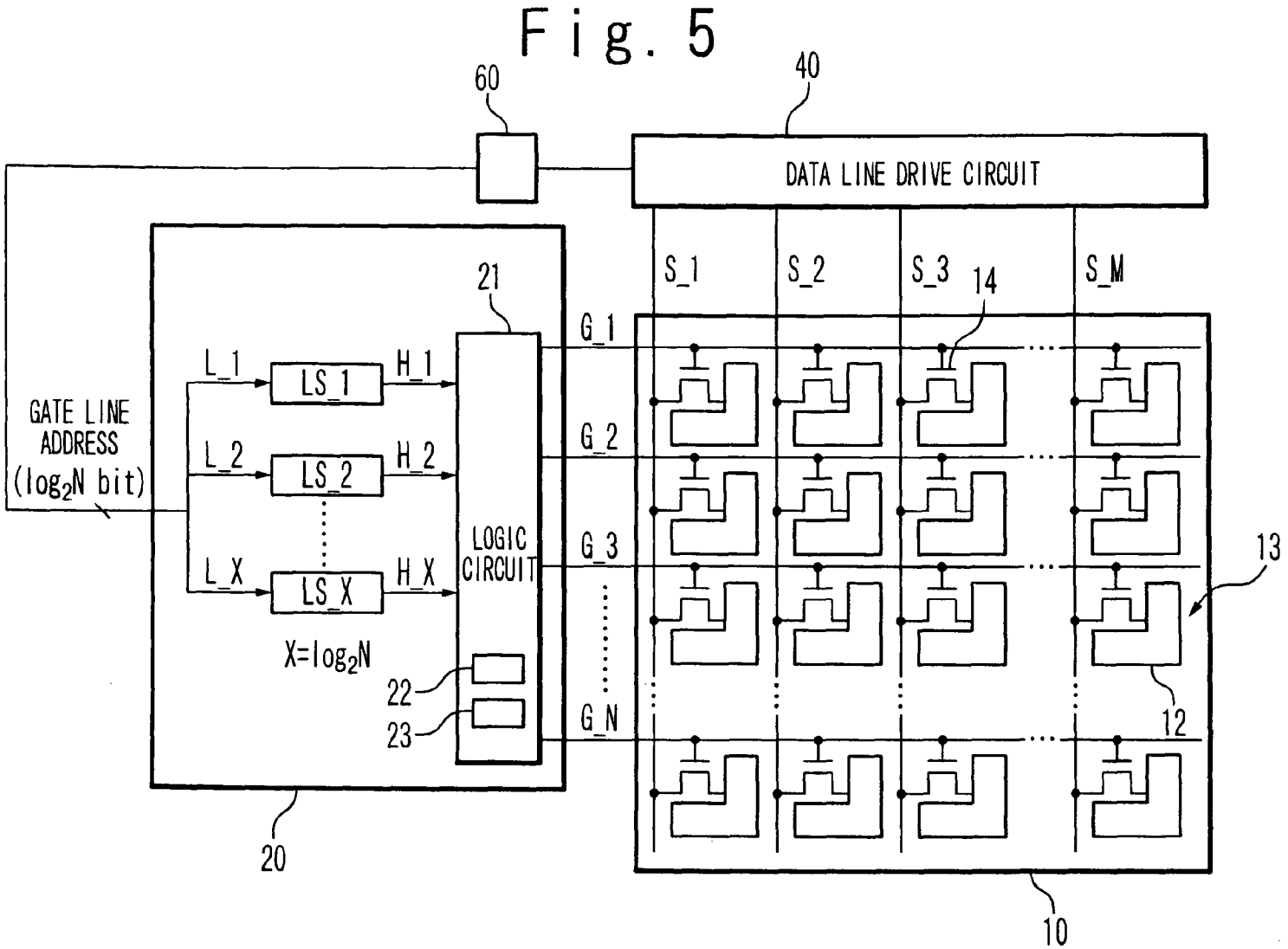
FIG. 5 shows a TFT-LCD to which a gate line drive circuit according to an embodiment of the present invention is applied.

FIG. 5 shows the TFT-LCD to which the gate line drive circuit according to the embodiment of the present invention is applied. The TFT-LCD includes a display unit (a liquid crystal display panel) 10. The liquid crystal display panel 10 includes a plurality of pixels 13 arranged in a matrix on a glass substrate. For example, (N×M) pixels are arranged as the plurality of pixels 13 on the glass substrate. The (N×M) pixels 13 are arranged in N rows and M columns. N represents 2 raised to the power X, where X is an integer of 1 or more. M represents an integer of 2 or more. M may represent an integer of 1 or more. Each of the (N×M) pixels 13 includes a thin-film transistor (TFT) 14 and a display region 12. The display region 12 includes a pixel capacitor (not shown in the figure). The pixel capacitor includes a pixel electrode and an opposite electrode opposed to the pixel electrode. The TFT 14 includes a drain electrode, a source electrode connected to the pixel electrode, and a gate electrode.

The TFT-LCD further includes N gate lines G_1 to G_N arranged in the order from the first gate line G_1 to the N-th gate line G_N and M data lines S_1 to S_M arranged in the order from the first data line S_1 to the M-th data line S_M. The gate line G_1 is connected to the gate electrodes of the TFTs 14 of the pixels 13 in a first row of the matrix. In the same manner, the gate lines G_2 to G_N are connected to the gate electrodes of the TFTs 14 of the pixels 13 in second to N-th rows of the matrix, respectively. Namely, the gate lines G_1 to G_N are respectively connected to the gate electrodes of the pixels 13 in the N rows. The data line S_1 is connected to the drain electrodes of the TFTs 14 of the pixels 13 in a first column of the matrix. In the same manner, the data lines S_2 to S_M are connected to the drain electrodes of the TFTs 14 of the pixels 13 in second to M-th columns of the matrix, respectively. Namely, the data lines S_1 to S_M are respectively connected to the drain electrodes of the pixels 13 in the M columns.

The TFT-LCD further includes the gate line drive circuit 20 according to the embodiment of the present invention and a data line drive circuit 40. The gate line drive circuit 20 is provided on a chip, and is connected to one ends of the N gate lines G_1 to G_N. The data line drive circuit 40 is provided on a chip, and is connected to one ends of the M data lines S_1 to S_M.

The TFT-LCD further includes a timing controller 60. The timing controller 60, for example, supplies a gate line address signal for selecting a selection gate line G_J (J is an integer satisfying $1 \leq J \leq N$) from the N gate lines G_1 to G_N to the gate line drive circuit 20 in one horizontal period. The gate line drive circuit 20 supplies a first driving voltage VGH for driving the selection gate line G_J to the selection gate line G_J based on the gate line address signal, and supplies a second driving voltage VGL for not driving non-selection gate lines which are gate lines other than the selection gate line G_J to the non-selection gate lines. The second driving voltage VGL is lower than the first driving voltage VGH. In this case, the first driving voltage VGH is transmitted from the one end to the other end of the selection gate line G_J, and the TFTs 14 of M pixels 13 corresponding to the selection gate line G_J (J-th row) are turned on by the first driving voltage VGH supplied to the gate electrodes of the TFTs 14.

In addition, the timing controller 60 supplies a clock signal and one line display data to the data line drive circuit 40. The one line display data includes M pieces of display data respectively corresponding to the M data lines S_1 to S_M. In response to the clock signal, the data line drive circuit 40 outputs the M pieces of display data to the M data lines S_1 to S_M, respectively. In this case, the TFTs 14 of the M pixels 13 corresponding to the selection gate line G_J (J-th row) and the M data lines S_1 to S_M are turned on. Here, the M pixels 13 are arranged in the J-th row and the gate electrodes of the TFTs 14 of the M pixels 13 are connected to the selection gate line G_J. Accordingly, the M pieces of display data are written to the display regions 12 of the pixels 13, respectively, and are retained until a next writing. In this manner, the M pieces of display data are displayed on the pixels 13 as the one line display data.

[Configuration]

The gate line drive circuit 20 according to the embodiment of the invention includes X level shift circuits LS_1 to LS_X and a logic circuit 21. X is an integer satisfying $X=\log_2 N$. The X level shift circuits LS_1 to LS_X are connected to the timing controller 60. The logic circuit 21 is connected to the X level shift circuits LS_1 to LS_X and the N gate lines G_1 to G_N.

As described above, the gate line address signal is supplied from the timing controller 60 to the X level shift circuits LS_1 to LS_X. The gate line address signal includes X bit signals L_1 to L_X. The X bit signals L_1 to L_X correspond to X bits, and represent one of decimal numbers 1 to N by using voltages representing binary numbers. The above-mentioned voltage represents a first voltage VDD for selecting the selection gate line G_J when representing "1" as a binary number, and represents a second voltage VCC for selecting the non-selection gate line when representing "0" as a binary number. The second voltage VCC is lower than the first voltage VDD. The first voltage VDD generally represents a voltage of approximately 1 to 5 [V], the second voltage VCC represents, for example, 0 [V] as a ground voltage. In addition, the above-mentioned first driving voltage VGH and the second driving voltage VGL are approximately 20 [V] and −20 [V], respectively. Accordingly, the X level shift circuits LS_1 to LS_X convert the first voltage VDD or the second voltage VCC represented by the X bit signals L_1 to L_X into the first driving voltages VGH or the second driving voltages VGL, and outputs the converted voltages as X bit signals H_1 to H_X to the logic circuit 21.

The logic circuit 21 includes a truth table 22 and a drive control unit 23. FIG. 6A shows the truth table 22. In the truth table 22, respective binary numbers from 0th to (X−1)th bits as the X bit signals H_1 to H_X are corresponded to the N gate lines G_1 to G_N as decimal numbers 1 to N. The drive control unit 23 refers to the truth table 22, when a decimal number represented by the X bit signals H_1 to H_X is J, supplies the first driving voltage VGH to the selection gate line G_J and supplies the second driving voltage VGL to the non-selection gate lines.

[Operation]

An operation of the gate line drive circuit 20 according to the embodiment of the present invention will be explained. Here, as an example, the first voltage VDD is set to 3 [V], the first driving voltage VGH is set to 15 [V], and the second driving voltage VGL is set to −10 [V]. In addition, N is set to 1024. Namely, X is set to 10. A case will be explained in which a gate line address signal of 10 bits is supplied to the gate line drive circuit 20 and the gate line drive circuit 20 drives a gate line G_1021 based on the gate line address signal.

The timing controller 60 supplies the gate line address signal to the level shift circuits LS_1 to LS_10. The level shift circuits LS_1 to LS_10 receive bit signals L_1 to L_10 as the gate line address signal. The bit signals L_1 to L_10 correspond to 0th to 9th bits of the gate line address signal, respectively. Hereinafter, for convenience of the explanation, the bit signals L_1 to L_10 are described as the bit signals L_10 to L_1, and the level shift circuits LS_1 to LS_10 are described as the level shift circuits LS_10 to LS_1.

The bit signals L_10 to L_1 indicate binary numbers corresponding to 9th to 0th bits, "1", "1", "1", "1", "1", "1", "1", "1", "0", and "1", respectively. When indicating a binary number "1", the bit signal indicates 3 [V] as the first voltage VDD. When indicating a binary number "0", the bit signal indicates 0 [V] as the second voltage VCC. Then, the level shift circuits LS_10 to LS_3 and LS_1 convert the voltages represented by the bit signals L_10 to L_3 and L_1 from the first voltage 3 [V] into the first driving voltage 15 [V], respectively, and output the converted voltages as the bit signals H_10 to H_3 and H_1 to the logic circuit 21. At the same time, the level shift circuit LS_2 converts the voltage represented by the bit signal L_2 from the second voltage 0 [V] into the second driving voltage −10 [V], and outputs the converted voltage to the logic circuit 21 as the bit signal H_2.

The drive control unit 23 receives the bit signals H_10 to H_1 from the level shift circuits LS_10 to LS_1. Referring to the truth table 22, the drive control unit 23 calculates or obtains a decimal number represented by the bit signals H_10 to H_1. The decimal number corresponds to the above-mentioned J. As shown in FIG. 6B, the binary numbers represented by the bit signals H_10 to H_1 are "1", "1", "1", "1", "1", "1", "1", "1", "0", and "1" in the order from the 9th bit to the 0th bit. For this reason, the drive control unit 23 calculates or obtains "1021" as a decimal number based on $2^9+2^8+2^7+2^6+2^5+2^4+2^3+2^2+0+2^0$. The drive control unit 23 recognizes the gate line G_1021 corresponding to the decimal number "1021" as the selection gate line, and recognizes the other gate lines G_1 to G_1020, and G_1022 to G_1024 as the non-selection gate lines. In this case, the drive control unit 23 supplies the first driving voltage of 15 [V] to the selection gate line G_1021, and supplies the second driving voltage of −10 [V] to the non-selection gate lines G_1 to G_1020 and G_1022 to G_1024. Namely, the drive control unit 23 drives the selection gate line G_1021 and does not drive the non-selection gate lines G_1 to G_1020 and G_1022 to G_1024.

[Advantages]

According to the above explanation, in the gate line drive circuit 20 according to the embodiment of the present invention, the address signals L_1 to L_X of X bits (X is an integer of 1 or more) which represent one of decimal numbers 1 to N (N is an integer of 2 raised to the power X) by using the voltages VDD and VCC indicating binary numbers are supplied to the X level shift circuits LS_1 to LS_X. At this time, the X level shift circuits LS_1 to LS_X convert X voltages VDD, VCC respectively corresponding to the X bits into driving voltages VGH, VGL for driving a selection gate line of the N gate lines G_1 to G_N, and output the converted voltages as the address signals H_1 to H_X to the logic circuit 21. When the address signals H_1 to H_X represent a decimal number J (J is an integer satisfying $1 \leq J \leq N$), the logic circuit 21 drives the J-th gate line G_J as the above-mentioned selection gate line. Here, when the address signals L_1 to L_X represent the decimal number J, the address signals H_1 to H_X represent the same decimal number J. In this manner, since the number of the required level shift circuits is only $\log_2 N$ when the number of the gate lines is N, the number of the level shift circuits can be reduced.

As described above, as for the conventional gate line drive circuit 120, the number of the level shift circuits used for driving the N gate lines G_1 to G_N is represented by $2 \times L+K$. For example, given that N is 1024 and L is 8, K is 128 based on $K=N/L$. In this case, the number of the level shift circuits is 144 based on $2 \times L+K$.

Meanwhile, as for the gate line drive circuit 20 according to the embodiment of the present invention, the number, X, of the level shift circuits LS_1 to LS_X used for driving the N gate lines G_1 to G_N is represented by $\log_2 N$. For example, given that N is 1024, X is 10 based on $X=\log_2 N$. Namely, the number of the level shift circuits LS_1 to LS_X according to the embodiment of the present invention is much smaller than the number of the level shift circuits in the conventional gate line drive circuit 120.

In addition, since the number of the level shift circuits LS_1 to LS_X in the gate line drive circuit 20 according to the embodiment of the present invention is much smaller than the number of the level shift circuits in the conventional gate line circuit 120, a chip area in a case that the gate line drive circuit 20 including the level shift circuits LS_1 to LS_X is formed on a chip can be significantly reduced as compared to a chip area in a case of the conventional gate line drive circuit 120. Moreover, a manufacturing cost of the chip can be significantly reduced.

For example, a gate line drive circuit 20 according to an embodiment can be recognized as follows. The gate line drive circuit 20 includes: X level shift circuits LS_1 to LS_X configured to convert first address signals L_1 to L_X into second address signals H_1 to H_X; and a logic circuit 21 configured to drive a selection gate line G_J of N gate lines G_1 to G_N of a display unit 10 based on the second address signals H_1 to H_X by supplying a first driving voltage VGH to the selection gate line and by supplying a second driving voltage VGL to non-selection gate lines of the N gate lines G_1 to G_N other than the selection gate line G_J. X is an integer of 1 or more. N is equal to 2 raised to a power X. The first address signals L_1 to L_X includes X voltages each of which is a first voltage VDD or a second voltage VCC. The second address signals H_1 to H_X includes X driving voltages each of which is the first driving voltage VGH or the second driving voltage VGL.

It is preferred that the X level shift circuits LS_1 to LS_N convert the first voltage VDD into the first driving voltage VGH and convert the second voltage VCC into the second driving voltage VGL.

The gate line drive circuit 20 preferably includes: a truth table 22 in which N patters of the X driving voltages are respectively corresponded to the N gate lines G_1 to G_N; and a drive control unit 23 configured to refer to the truth table 22 to supply the first driving voltage VGH and the second driving voltage VGL to the selection gate line G_J and the non-selection gate lines, respectively.

For example, a display device according to an embodiment can be recognized as follows. The display device includes: a display unit 10 including pixels 13 arranged in N rows and M columns; N gate lines G_1 to G_N respectively corresponding to the N rows; M data lines S_1 to S_M respectively corresponding to the M columns; a gate line drive circuit 20 connected to the N gate lines G_1 to G_N and configured to drive a selection gate line G_J of the N gate lines G_1 to G_N; and a data line drive circuit 40 connected to the M data lines S_1 to S_M and configured to display pieces of display data on first pixels 13 of the pixels 13, wherein the first pixels 13 are connected to the selection gate line G_J. The data line drive circuit 20 includes: X level shift circuits LS_1 to LS_X configured to convert first address signals L_1 to L_X into second address signals H_1 to H_X; and a logic circuit 21 configured to supply a first driving voltage VGH to the selection gate line G_J to drive the selection gate line G_J and supply a second driving voltage VGL to non-selection gate lines of the N gate lines G_1 to G_N other than the selection gate line G_J not to drive the non-selection gate lines based on the second address signals H_1 to H_X. X is an integer of 1 or more. N is equal to 2 raised to a power X. M is an integer of 1 or more. The first address signals L_1 to L_X includes X voltages each of which is a first voltage VDD or a second voltage VCC. The second address signals H_1 to H_X includes X driving voltages each of which is the first driving voltage VGH or the second driving voltage VGL.

The X level shift circuits LS_1 to LS_X preferably convert the first voltage VDD into the first driving voltage VGH and convert the second voltage VCC into the second driving voltage VGL.

The logic circuit 21 preferably includes: a truth table 22 in which N patters of the X driving voltages are respectively corresponded to the N gate lines G_1 to G_N; and a drive control unit 23 configured to refer to the truth table 22 to supply the first driving voltage VGH and the second driving voltage VGL to the selection gate line G_J and the non-selection gate lines, respectively.

For example, a gate line driving method according to an embodiment can be recognized as follows. The gate line driving method includes: converting first address signals L_1 to L_X into second address signals H_1 to H_X; and driving a selection gate line G_J of N gate lines G_1 to G_N of a display unit 10 based on the second address signals H_1 to H_X by supplying a first driving voltage VGH to the selection gate line G_J and by supplying a second driving voltage VGL to non-selection gate lines of the N gate lines G_1 to G_N other than the selection gate line G_J. N is equal to 2 raised to a power X. X is an integer of 1 or more. The first address signals L_1 to L_X includes X voltages each of which is a first voltage VDD or a second voltage VCC. The second address signals H_1 to H_X includes X driving voltages each of which is the first driving voltage VGH or the second driving voltage VGL.

The converting the first address signals L_1 to L_X into the second address signals H_1 to H_X preferably includes: converting the first voltage VDD into the first driving voltage VGH; and converting the second voltage VCC into the second driving voltage VGL.

The driving the selection gate line G_J includes referring to a truth table 22 in which N patters of the X driving voltages are respectively corresponded to the N gate lines G_1 to G_N.

In another example, a gate line drive circuit 20 according to an embodiment can be recognized as follows. The gate line drive circuit 20 includes X level shift circuits LS_1 to LS_X and a logic circuit 21. X is an integer of 1 or more. The X level shift circuits LS_1 to LS_X are supplied with address signals of X bits. The address signals represent one of decimal numbers 1 to N by using X voltages VDD, VCC respectively corresponding to the X bits. N is equal to 2 raised to a power X. The X voltages VDD, VCC represent binary numbers 1, 0. The X level shift circuits LS_1 to LS_X convert the X voltages VDD, VCC into driving voltages VGH, VGL for driving a selection gate line of N gate lines G_1 to G_N. The logic circuit 21 is connected to the N gate lines G_1 to G_N. When the address signals represent a decimal number J which is an integer not smaller than 1 and not larger than N, the logic circuit drives a j-th gate line G_J of the N gate lines G_1 to G_N as the selection gate line.

The gate line drive circuit 20 preferably includes a truth table 22 in which binary numbers from 0th to (X−1) th bits as the address signals are respectively corresponded to the N gate lines as the decimal numbers 1 to N; and a drive control unit 23 configured to refer to the truth table 22. When the address signals represent the decimal number J, the drive control unit 23 supplies a first driving voltage VGH for driving the J-th gate line G_J as the selection gate line to the selection gate line G_J and supplies a second driving voltage VGL for not driving non-selection gate lines of the N gate lines G_1 to G_N, which are other than the selection gate line G_J, to the non-selection gate lines.

In another example, a display device according to an embodiment can be recognized as follows. The display device includes: a display unit 10 including pixels 13 arranged in N rows and M columns; N gate lines G_1 to G_N respectively connected to pixels 13 in the N rows; M data lines S_1 to S_M respectively connected to pixels 13 in the M columns; a gate line drive circuit 20 connected to the N gate lines G_1 to G_N and configured to drive a selection gate line of the N gate lines G_1 to G_N; and a data line drive circuit 40 connected to the M data lines S_1 to S_M and configured to display pieces of display data on pixels 13 of the display unit 10, which correspond to the selection gate line and the M data lines. M is an integer of 1 or more. The gate line drive circuit 20 includes: X level shift circuits LS_1 to LS_X; and a logic circuit 21. X is an integer of 1 or more. The X level shift circuits LS_1 to LS_X are supplied with address signals of X bits. The address signals represent one of decimal numbers 1 to N by using X voltages VDD, VCC respectively corresponding to the X bits. N is equal to 2 raised to a power X. The X voltages VDD, VCC represent binary numbers 1, 0. The X level shift circuits LS_1 to LS_X convert the X voltages VDD, VCC into driving voltages VGH, VGL for driving a selection gate line of N gate lines G_1 to G_N. The logic circuit 23 is connected to the N gate lines G_1 to G_N. When the address signals represent a decimal number J which is an integer not smaller than 1 and not larger than N, the logic circuit 23 drives a J-th gate line G_J of the N gate lines G_1 to G_N as the selection gate line.

The logic circuit 21 of the display device preferably includes: a truth table 22 in which binary numbers from 0th to (X−1) th bits as the address signals are respectively corresponded to the N gate lines as the decimal numbers 1 to N; and a drive control unit 23 configured to refer to the truth table 22. When the address signals represent the decimal number J, the drive control unit 23 supplies a first driving voltage VGH for driving the J-th gate line G_J as the selection gate line to the selection gate line G_J and supplies a second driving voltage VGL for not driving non-selection gate lines of the N gate lines G_1 to G_N, which are other than the selection gate line G_J, to the non-selection gate lines.

In another example, a gate line driving method according to an embodiment can be recognized as follows. The gate line driving method includes: supplying address signals of X bits, which indicates one of decimal numbers 1 to N by using X voltages VDD, VCC respectively corresponding to the X bits, wherein X is an integer of 1 or more, N is equal to 2 raised to a power X, and the X voltages VDD, VCC represent binary numbers 1, 0; converting the X voltages into driving voltages VGH, VGL for driving a selection gate line of N gate lines G_1 to G_N; and when the address signals represent a decimal number J which is an integer not smaller than 1 and not larger than N, driving a J-th gate line G_J of the N gate lines G_1 to G_N as the selection gate line.

It is preferable that the driving the J-th gate line G_J in the gate line driving method includes: referring to a truth table 22 in which binary numbers from 0th to (X−1)th bits as the address signals are respectively corresponded to the N gate lines as the decimal numbers 1 to N; and when the address signals represent the decimal number J, supplying driving voltages VGH, VGL. The supplying driving voltages VGH, VGL includes: supplying a first driving voltage VGH for driving the J-th gate line G_J as the selection gate line to the selection gate line; and supplying a second driving voltage VGL for not driving non-selection gate lines of the N gate lines G_1 to G_N, which are other than the selection gate line G_J, to the non-selection gate lines.

It is apparent that the present invention is not limited to the above embodiments, but may be modified and changed without departing from the scope and spirit of the invention.

What is claimed is:

1. A gate line drive circuit comprising:

X level shift circuits configured to convert first address signals into second address signals; and a logic circuit configured to drive a selection gate line of N gate lines of a display unit based on said second address signals by supplying a first driving voltage to said selection gate line and by supplying a second driving voltage to non-selection gate lines of said N gate lines other than said selection gate line, wherein:

X is an integer of 1 or more,

N is equal to 2 raised to a power X, said first address signals includes X voltages each of which is a first voltage or a second voltage, and said second address signals includes X driving voltages each of which is said first driving voltage or said second driving voltage.

2. The gate line drive circuit according to claim 1, wherein said X level shift circuits convert said first voltage into said first driving voltage and convert said second voltage into said second driving voltage.

3. The gate line drive circuit according to claim 1, wherein said logic circuit includes:

a truth table in which N patterns of said X driving voltages are respectively corresponded to said N gate lines; and a drive control unit configured to refer to said truth table to supply said first driving voltage and said second driving voltage to said selection gate line and said non-selection gate lines, respectively.

4. A display device comprising:

a display unit including pixels arranged in N rows and M columns;

N gate lines respectively corresponding to said N rows;

M data lines respectively corresponding to said M columns;

a gate line drive circuit connected to said N gate lines and configured to drive a selection gate line of said N gate lines; and a data line drive circuit connected to said M data lines and configured to display pieces of display data on first pixels of said pixels, wherein said first pixels are connected to said selection gate line, wherein said data line drive circuit includes:

X level shift circuits configured to convert first address signals into second address signals; and a logic circuit configured to supply a first driving voltage to said selection gate line to drive said selection gate line and supply a second driving voltage to non-selection gate lines of said N gate lines other than said selection gate line not to drive said non-selection gate lines based on said second address signals, X is an integer of 1 or more, N is equal to 2 raised to a power X, M is an integer of 1 or more, said first address signals includes X voltages each of which is a first voltage or a second voltage, and said second address signals includes X driving voltages each of which is said first driving voltage or said second driving voltage.

5. The display device according to claim 4, wherein said X level shift circuits convert said first voltage into said first driving voltage and convert said second voltage into said second driving voltage.

6. The display device according to claim 4, wherein said logic circuit includes:

a truth table in which N patterns of said X driving voltages are respectively corresponded to said N gate lines; and a drive control unit configured to refer to said truth table to supply said first driving voltage and said second driving voltage to said selection gate line and said non-selection gate lines, respectively.

7. A gate line driving method comprising:

converting first address signals into second address signals; and driving a selection gate line of N gate lines of a display unit based on said second address signals by supplying a first driving voltage to said selection gate line and by supplying a second driving voltage to non-selection gate lines of said N gate lines other than said selection gate line, wherein N is equal to 2 raised to a power X, X is an integer of 1 or more, said first address signals includes X voltages each of which is a first voltage or a second voltage, and said second address signals includes X driving voltages each of which is said first driving voltage or said second driving voltage.

8. The gate line driving method according to claim 7, wherein said converting said first address signals into said second address signals includes:

converting said first voltage into said first driving voltage; and converting said second voltage into said second driving voltage.

9. The gate line driving method according to claim 7, wherein said driving said selection gate line includes referring to a truth table in which N patterns of said X driving voltages are respectively corresponded to said N gate lines.

10. The gate line drive circuit according to claim 1, wherein the first address signals comprise X number of signals, each including X bits (X is an integer of 1 or more) indicating one of decimal numbers 1 to N (N is an integer of 2 raised to the power X) by using the X voltages indicating binary numbers are supplied to the X level shift circuits, the first address signals includes the X voltages indicating binary numbers, each of the X voltages is the first voltage or the second voltage.

11. The gate line drive circuit according to claim 10, wherein the X level shift circuits convert X voltages respectively corresponding to the X bits into X number of high and low driving voltages for driving a selection gate line of the N gate lines, and output the converted X voltages as the second address signals to the logic circuit.

12. The gate line drive circuit according to claim 1, wherein when the second address signals represent a decimal number J (J is an integer satisfying $1 \leq J \leq N$), the logic circuit drives a J-th gate line as the selection gate line.

13. The gate line drive circuit according to claim 12, wherein when X number of the first address signals represent the decimal number J, X number of second address signals represent the same decimal number J.

14. A gate line drive circuit comprising:

a plurality of level shift circuits configured to convert first address signals into second address signals; and a logic circuit configured to drive a selection gate line of N gate lines of a display unit based on said second address signals by supplying a first driving voltage to said selection gate line and by supplying a second driving voltage to non-selection gate lines of said N gate lines other than said selection gate line, wherein a number X, of the plurality of level shift circuits for driving the N gate lines is represented by $\log_2 N$, where X is an integer of at least 1.

15. The gate line drive circuit according to claim 14, wherein said first address signals includes X voltages each of which is a first voltage or a second voltage, and wherein said second address signals includes X driving voltages each of which is said first driving voltage or said second driving voltage.

16. The gate line drive circuit according to claim 14, wherein said logic circuit comprises:

a truth table in which N patterns of said X driving voltages are respectively corresponded to said N gate lines; and a drive control unit configured to refer to said truth table to supply said first driving voltage and said second driving voltage to said selection gate line and said non-selection gate lines, respectively.

17. The gate line drive circuit according to claim 1, wherein said X level shift circuits provide exactly N gate lines, where N is equal to 2 raised to a power of X number of level shift circuits.

18. The display device according to claim 4, wherein said X level shift circuits provide exactly N gate lines, where N is equal to 2 raised to a power of X number of level shift circuits.

19. The gate line driving method according to claim 7, wherein said X voltages provide exactly N gate lines, where N is equal to 2 raised to a power of X number of voltages.

20. The gate line drive circuit according to claim 14, wherein said X level shift circuits provide exactly N gate lines, where N is equal to 2 raised to a power of X number of level shift circuits.

* * * * *

UNITED STATES PATENT AND TRADEMARK OFFICE

CERTIFICATE OF CORRECTION

PATENT NO. : 8,730,142 B2
APPLICATION NO. : 12/461084
DATED : May 20, 2014
INVENTOR(S) : Takayuki Shu It is certified that error appears in the above-identified patent and that said Letters Patent is hereby corrected as shown below:

On the Title Page

In particular, it is requested that the first Foreign Application Filing Date be corrected as follows:

Item (30) Foreign Application Priority Data

August 5, 2008 (JP)…….. 2008-202187

Signed and Sealed this
Twenty-third Day of September, 2014

Michelle K. Lee

Michelle K. Lee
*Deputy Director of the United States Patent and Trademark Office*